United States Patent [19]

Lapcevic

[11] 4,406,452

[45] Sep. 27, 1983

[54] WEIGHT LIFTING EXERCISE DEVICE

[76] Inventor: Paul S. Lapcevic, R.D. #1, Scenery Hill, Pa. 15360

[21] Appl. No.: 334,129

[22] Filed: Dec. 24, 1981

[51] Int. Cl.[3] ..... A63B 13/00

[52] U.S. Cl. ..... 272/123; 272/DIG. 4; 272/117

[58] Field of Search ..... 272/117, 116, 93, 123, 272/134, 143

[56] References Cited

U.S. PATENT DOCUMENTS

| | | | |
|---|---|---|---|
| 2,932,509 | 4/1960 | Zinkin | 272/117 |
| 3,918,710 | 11/1975 | Niebojewski | 272/134 X |
| 4,344,619 | 8/1982 | Szabo | 272/117 |

*Primary Examiner*—Richard J. Apley
*Assistant Examiner*—William R. Browne
*Attorney, Agent, or Firm*—Paul Bogdon

[57] ABSTRACT

A weight lifting exercise device is described. The device includes a generally box-shaped main support frame formed of vertical upright supports interconnected by horizontal cross-members. An elongated exercise beam member is pivotably supported at one end thereof by the main support frame for vertical movement about the pivot point. The pivot point may be selectively positioned on the main frame. A weight support assembly is connected to the exercise beam member. The weight support assembly includes bearings supported within the beam member, an elongated shaft supported by the bearings, and a weight support frame fixed to the shaft. The bearings are constructed to allow rectilinear and axial rotational movement of the weight support frame relative to the beam member during exercise cycles. The weight support frame includes gripping devices to be grasped by a user, and bars for supporting main weight members and drag force weights.

5 Claims, 3 Drawing Figures

WEIGHT LIFTING EXERCISE DEVICE

BACKGROUND OF THE INVENTION

This invention relates to a single-station type body exercising weight lifting device.

Single-station type weight lifting exercise devices are well-known and currently in widespread use. Many of the known devices have variable weight capability and are provided with a pivotable weight support frame which is vertically movable about its pivot point. Such known weight lifting devices are restricted because the weight support frame is capable of being moved only through an arcuate path. Thus, the fixed lever devices are limited in their range of possible exercises and require the user to conform his or her exercising to the devices' fixed path of travel. In other words, the fixed lever exercise devices do not allow the natural movements of free weight lifting exercising. Free weight lifting has a wide range of movement which is highly desireable since it gives the user the versatility of personalizing exercise programs to fit his or her needs. Fixed lever devices do not permit that versatility.

This invention overcomes the exercise limitations inherent in heretofore known weight lifting exercising devices by providing such a device having the standard lifting capability together with push-pull capability. By providing the push-pull capability the user of the device of this invention is able to move the weight support frame along paths very close to or even the same as the paths that would be followed in free weight lifting. Thus, the exercise device is not limited to a fixed arc movement path. The present invention also has a secondary feature, that being the capability of the weight support frame to be rotated about its longitudinal axis thereby resulting in the user getting equal force balance in both his or her limbs over the different exercise cycles. Without the rotational capability, as is the case with known weight lifting devices, one arm or leg may apply more lifting force than the other. The weight support frame rotational aspect of this invention is also consistent with the natural movements of free weight lifting. Thus, this invention provides a single-station type exercise device with the inherent advantages of all such devices, and with the significant advantage of having free weight lifting movement capability.

SUMMARY OF THE INVENTION

This invention provides a weight lifting device which preferably comprises: a main support frame including upright members interconnected with cross-members; elongated exercise beam means pivotably supported at one end thereof by the main frame for vertical movement about the pivot point; and weight support means supported by the exercise beam means for selective rectilinear movement with respect to the exercise beam means during exercise cycles, and for detachably securing a plurality of weight members, and for being grasped to urge vertical movement to the exercise beam means and rectilinear movement to the weight support means. Means may also be provided allowing the weight support means to be rotated with respect to the exercise beam during exercise cycles. The combined capability of the rectilinear and rotational movement of the pivotable weight support means allows movements of the weights very closely approaching the natural movements of free weight lifting.

This invention has yet another advantage which even free weight lifting does not have. My exercise device is capable of applying the inclined plane force principal during certain exercise cycles. The inclined plane principal requires more force to lift the weights as the weights are moved up the path of travel. Weight exercisers desire that feature in order to obtain maximum workable resistance through the exercise cycle. The translational movement capability coupled with the pivotable movement of the weight support means provides my device with inclined plane capacity. The invention may also be provided with means for selectively adjusting the vertical plane of the pivot point of the exercise beams whereby the range of the inclined plane principal may be varied. In addition, means may be provided in the weight support means for supporting drag weights whereby additional working resistance may be added over the exercise range, as desired by the user.

Various other advantages, details, and modifications of the present invention will become apparent as the following description of a certain present preferred embodiment proceeds.

DESCRIPTION OF THE DRAWINGS

In the accompanying drawings I show a certain present preferred embodiment of my invention in which.

DESCRIPTION OF A PREFERRED EMBODIMENT

Figure 2:
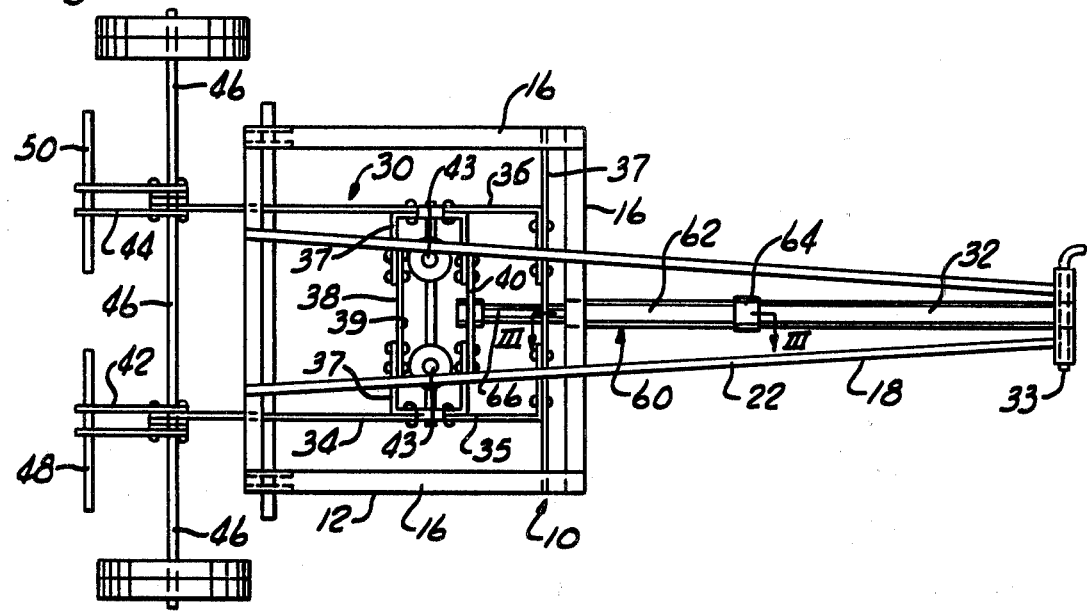
FIG. 2 is a view looking along the line II—II of FIG. 1.

Referring now to the drawings there is shown a weight lifting exercise device 10 embodying the present invention. The exercise device 10 includes a box-shaped main frame 12 formed by a series of interconnected vertical and horizontal beam members 14 and 16, respectively, arranged such that the device may stably rest on a floor surface. The main frame 12 also includes a rearwardly extending support frame 18 likewise formed of interconnected vertical and horizontal beam members 20 and 22, respectively. A weight support assembly 30 is arranged within the main frame 12, and includes an elongated, tubular exercise beam 32 pivotably connected by pivot pin 33 to rear vertical members 20 of the rearward support frame 18. The exercise beam 32 is arranged for only vertical movement about the pivot pin 33. Pivot pin 33 is selectively removable from the vertical members 20 which are provided with series of regularly vertically spaced openings 21. The pivot point of the exercise beam 32 may be varied vertically as desired by removing the pivot pin 33 and shifting the exercise beam to the desired pivot point location and then inserting the pivot pin in the openings 21 at that location. The weight support asembly 30 also includes a weight support frame 34 formed by interconnected, generally flat side members 35 and 36 and rear member 37. The weight support frame 34 is provided with a mid section 38 formed by a pair of oppositely disposed U-sections 37 secured to side members 35 and 36, and front and rear plates 39 and 40 secured to the free ends of the U-sections. A drag weight support bar 41 is fixed between U-sections 37, and includes spaced uprightly extending rods 43 for receiving weight members. The remainder of the weight support frame 34 includes yokes 42 and 44 secured to the ends of side members 35 and 36; an elongated weight support bar 46 for supporting standard type weights, the bar 46 being fixed to upper portions of the yokes 42 and 44; and gripper bars 48 and 50 secured to the lower portion of the yokes 42 and 44. The gripper bars 48 and 50 are arranged to be grasped on their respective inside or outside sections as desired for particular exercises.

The weight support frame 34 is connected to the exercise beam 32 by a linear movement assembly 60 which is constructed and arranged to permit the weight support frame to be moved rectilinearly or axially rotationally during exercise cycles with respect to the exercise beam while also allowing vertical movement force to be transmitted to the exercise beam. The linear movement assembly 60 includes an elongated, tubular bearing housing 62 secured at the rearward end by coupling 64 to the free end of exercise beam 32. Disposed at either end of the bearing housing 62 are linear bearings 65, to be more fully described hereinafter. An elongated shaft 66 is arranged to be supported by the linear bearings 65, the shaft being fixed at its forward end to the rear plate 40 of mid section 38. The rear section of shaft 66 extends into the confines of the exercise beam 32 and is provided with stop member 68 on its rearward end.

Figure 1:
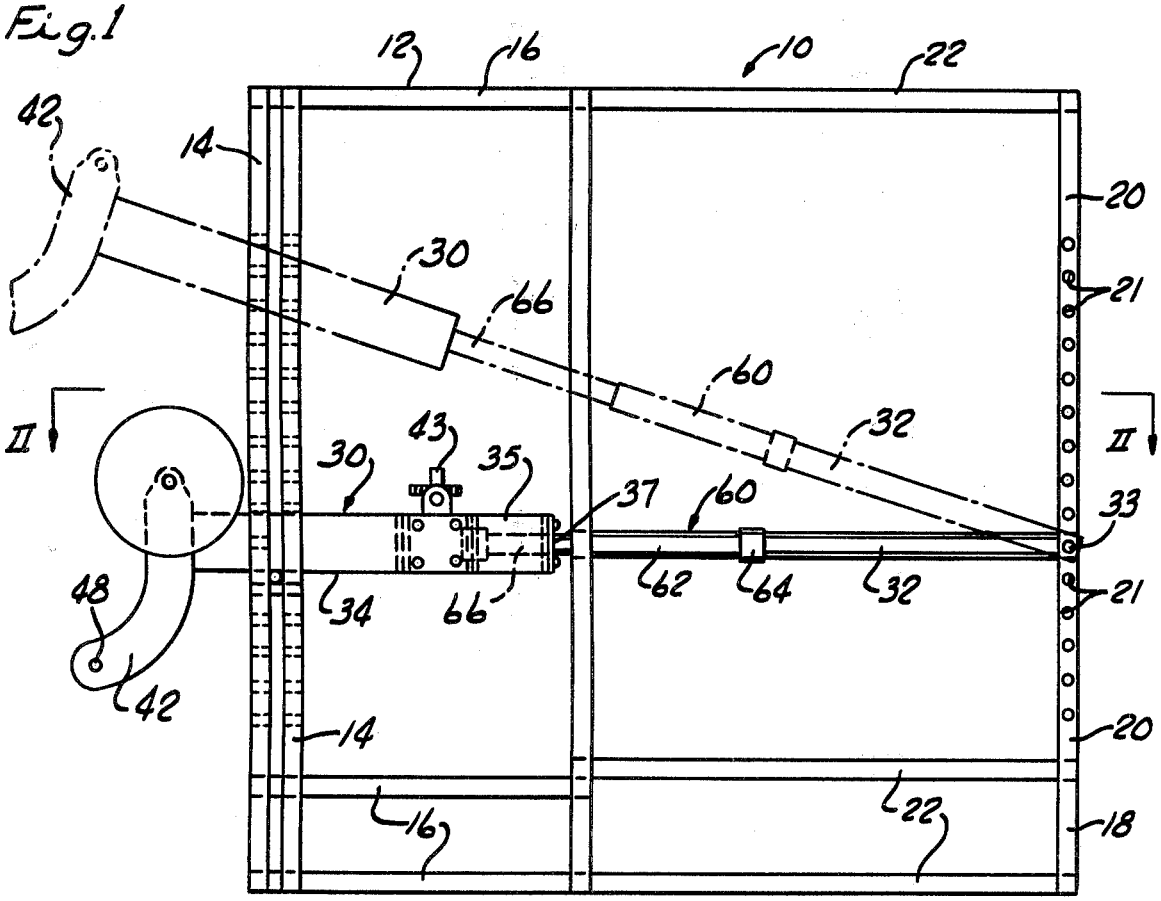
FIG. 1 is an elevation view partly in section of a weight lifting exercise device embodying this invention with movement of an exercise cycle shown in phantom outline.
Figure 3:
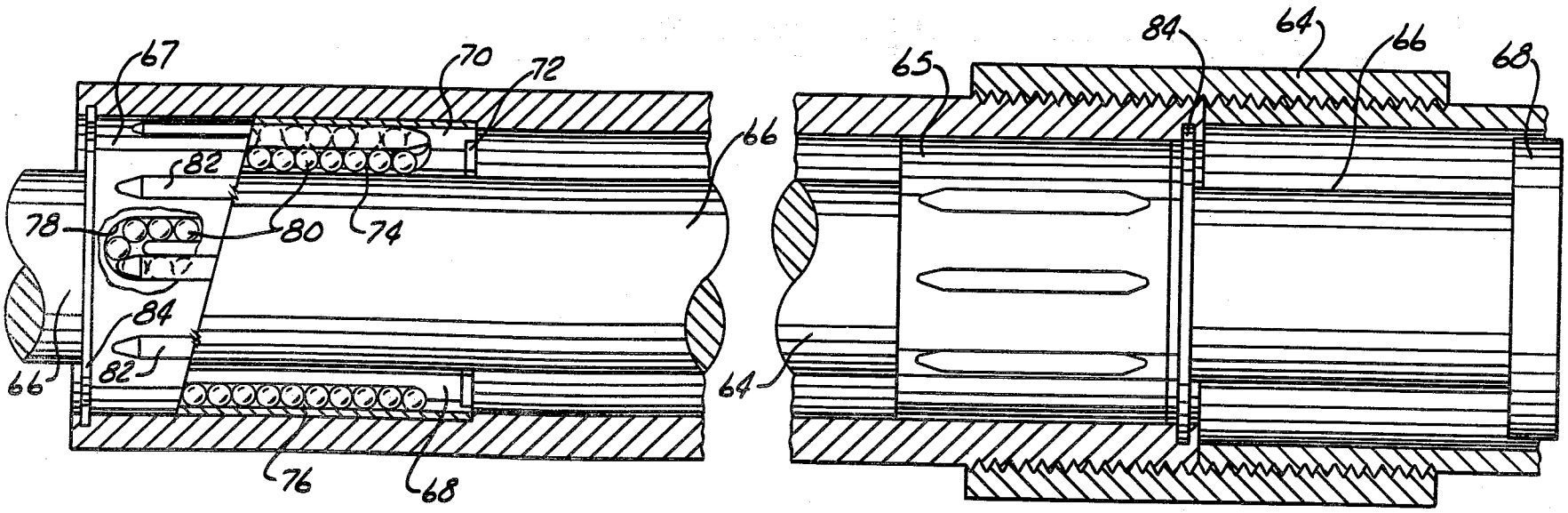
FIG. 3 is an enlarged view along the line III—III of FIG. 2 showing the internal construction of part of the weight support assembly of this invention and particularly showing the bearing construction which permits rectilinear and axial rotational movements of the weight support assembly during exercise cycles.

The linear bearings 65 are identical in construction and the forward bearing will be described with the understanding that the same description applies to the rearward bearing. The linear bearing 65 is the same in construction as the bearing described in U.S. Pat. No. 3,692,371, and the particular structure of the bearing is not claimed here. The significance of this invention is the ability of the weight support frame 34 to be translated and rotated with respect to the exercise beam 32, and the linear bearing 65 to be described provide means to achieve those movements. The foreward linear bearing 65 shown in detail in FIG. 3 is the same as that illustrated in FIG. 1 of U.S. Pat. No. 3,692,371, and the following description is a shorter version of the description in the patent. Reference is made to the patent for a complete illustration and description of the bearing. Bearing 65 comprises an annular housing 67 having a retainer element 68 and sleeve 70 connected to each other for conjoint rotation and co-linear movement by end caps 72. Housing 67 is provided with endless bearing paths including an active portion 74 and an inactive portion 76. Each active portion 74 is operatively connected with the inactive portion 76 of its respective endless path by a smooth curved end 78 at each end of the bearing path. The smooth curved ends 78 define an uninterrupted connection between the active and inactive portions 74 and 76 of each of the endless pathways. The curved ends 78 terminate each portion 74 and 76 to effect a smooth merger between such portions and along which load bearing elements may move unencumbered and unobstructed.

Spherical load bearing elements 80 are received within the endless bearing paths. There are also provided bearing elements 82 in the form of rollers extending across the complete lengths of slots formed in retainer 68. Bearing elements 82 are in communication with the spherical bearing elements 80. The construction and arrangement of the bearing elements 80 and 82, the endless paths formed by active and inactive portions 74 and 76, end caps 72, retainer elements 68, and the other elements comprising the linear bearing 65, are such that shaft 66 may move linearly and/or rotatively relative to bearing housing 62 and exercise beam 32.

The linear bearings 65 are secured within bearing housing 62 in countersunk end sections of the bearing housing. The bearings 65 may be secured by way of interference fit between the housings 67 of the bearings and the inner surface of the countersunk sections, or the bearings may be retained by snap rings 84 or similar locking members.

In using the weight lifting device 10 of this invention, weights of any desired size and number may be secured to the outer ends of weight support bar 46. The user may then grasp the gripper bars 48 and 50 and push or lift upwardly whereby the weight support frame 34, linear movement assembly 60, and exercise beam 32, all comprising the weight support assembly 30, are pivoted upwardly. At some point along the ascent of the weight support assembly 30, the user may desire to apply rectilinear movement to the weights at which time he exerts the necessary directionaly forces whereby the weight support frame 34 will translate relative to the exercise beam 32. A user would apply rectilinear movement when applying the inclined plan principal, earlier described. The user would also apply rectilinear movement during exercises such as bench pressing so as to obtain a near true or natural vertical movement of the weights. Similarly, the weight assembly 30 would be moved rectilinearly as well as pivotably during curling exercises. These combined rectilinear and pivotable movements just described are but a few examples of the natural free weight lifting type movements that the device of this invention is capable of performing. The added inclined plane capability for providing maximum workable resistance through as much of the range of certain exercise cycles as possible results from the combined rectilinear-pivotable movement and variable pivot point position of the weight support assembly.

The rotational capability of the weight support assembly 30 of my invention also allows the natural free weight lifting feel of the weights. Also, the rotational capability gives a weight lifting balance to the limbs being exercised. For example, if the user were bench pressing and during the exercise cycle one arm was dominating the push the weight support assembly 30 would start rotating. The user would compensate by pushing hard with the other arm to resist rotation whereby both arms would be applying near equal force to the weight support assembly 30. Thus, both arms would be in balance over the exercise cycle. In a fixed beam device one limb might dominate the exercise without that imbalance being apparent to the person using that device.

It should be clearly recognized that the primary essence of this invention is its capability of rectilinear and pivotable movement of the weights during exercise cycles. A secondary and very important feature of this invention is the added capability of the rotational movement of the weights. With that understanding of the significance of this invention it should now be also clear to those skilled in this art that my device provides a single-station type weight lifting exercise device which permits exercising much like natural free weight lifting, as well as having the added advantage, not permitted by free weight lifting, of providing the inclined plan principal for allowing maximum possible workable resistance through much of the range of certain exercise cycles.

This invention has been described in an arm lifting and pushing setting. Those skilled in this art should well understand that this invention is also applicable to a device having leg exercise capacity, as well as being applicable to other exercise modifications.

While I have shown and described a present preferred embodiment of this invention, it is to be distinctly understood that the invention is not limited thereto, but may be otherwise embodied within the scope of the following claims.

I claim:

1. A weight lifting exercise device comprising:

a main support frame including upright members interconnected with cross-members;

elongated exercise beam means pivotably supported at one end thereof by said main support frame for vertical movement about the pivot point; and weight support means supported by said exercise beam means for both rectilinear and longitudinally axial rotational movements with respect to said exercise beam means during vertical movement of said exercise beam means, and for detachably securing a plurality of weight members, and for being grasped to urge vertical movement to said exercise beam means and rectilinear and rotational movements to the weight support means.

2. A weight lifting exercise device as set forth in claim 1 wherein said weight support means includes a weight support frame fixed to said shaft member; gripping means secured to said frame; and bar means secured to said weight support frame for supporting weight members on opposite ends thereof.

3. A weight lifting exercise device as set forth in claim 1 including drag weight support means supported by said weight support means for detachably supporting drag weight members.

4. A weight lifting exercise device as set forth in claim 1 wherein said exercise support means including bearing means supported within said exercise beam means, and an elongated shaft member supported by said bearing means, said bearing means constructed to permit said shaft member to be moved axially rectilinearly and/or axially rotationally with respect to said exercise beam means.

5. A weight lifting exercise device as set forth in claim 1 including means for selectively varying the vertical position of the pivot point of said exercise beam means.

* * * * *